United States Patent [19]

Mierzwinski et al.

[11] Patent Number: 4,872,828

[45] Date of Patent: Oct. 10, 1989

[54] INTEGRATED FURNACE CONTROL AND CONTROL SELF TEST

[75] Inventors: Eugene P. Mierzwinski; Michael T. Grunden; Stephen E. Youtz, all of Ft. Wayne, Ind.

[73] Assignee: Hamilton Standard Controls, Inc., Farmington, Conn.

[21] Appl. No.: 95,508

[22] Filed: Sep. 10, 1987

[51] Int. Cl.[4] ..... F23N 5/24

[52] U.S. Cl. ..... 431/16; 431/24; 431/26

[58] Field of Search ..... 431/14–16, 431/24–26; 340/578, 653

[56] References Cited

U.S. PATENT DOCUMENTS

| | | | |
|---|---|---|---|
| 3,023,803 | 3/1962 | Deziel | 431/26 |
| 3,143,162 | 8/1964 | Graves et al. | 431/26 |
| 3,263,730 | 8/1966 | Guiffsida | 431/26 |
| 3,576,556 | 4/1971 | Sellors, Jr. | 340/228 |
| 3,781,161 | 12/1973 | Schuss | 431/16 |
| 3,781,161 | 12/1973 | Schuss | 431/16 |
| 3,999,933 | 12/1976 | Murphy | 431/15 |
| 4,146,086 | 3/1979 | Hobbick et al. | 165/25 |
| 4,188,182 | 2/1980 | Junak | 431/80 |
| 4,243,372 | 1/1981 | Cade | 431/31 |
| 4,295,129 | 10/1981 | Cade | 340/520 |
| 4,382,770 | 5/1983 | Pinckaers | 431/26 |
| 4,402,663 | 9/1983 | Romanelli et al. | 431/66 |
| 4,444,551 | 4/1984 | Mueller et al. | 431/25 |
| 4,685,615 | 8/1987 | Hart | 236/94 |
| 4,695,246 | 9/1987 | Beilfuss et al. | 431/31 |

*Primary Examiner*—Martin P. Schwadron
*Assistant Examiner*—Allen J. Flanigan

[57] ABSTRACT

An integrated electronic control arrangement is disclosed in the illustrative environment of a gas-fired furnace. The control incororates a self-test feature which shuts down the furnace and displays a diagnostic fault code in the event of any one of a number of possible sensed faults. Self-testing occurs automatically before an attempt at ignition and during furnace operation. The self-test may also be initiated manually at any time the furnace is not operating. The control accepts digital information on daily temperature setback, weekend temperature setback and vacation setback in any one of several preset schedules and preset setback increments. The control has a multipurpose display for selectively showing component indicative failure codes, temperature setback schedules, time of day, and day of the week.

13 Claims, 6 Drawing Sheets

INTEGRATED FURNACE CONTROL AND CONTROL SELF TEST

SUMMARY OF THE INVENTION

The present invention relates generally to electronic controls for burners, furnaces and the like, and more particularly to an integrated control for such burners in the illustrative environment of a gas-fired furnace.

Older furnace control systems have taken a modular approach with separate controls for functions such as gas ignition, a blower fan, the gas valve or valves, induced draft sensing, and thermostat setback operations. The integrated furnace control has taken all of the furnace control functions and combined them with the thermostat setback function into one main control module. The combining of all these functions into one complete module has made the system more cost effective than using separate components, allows many additional features, and provides a safer control.

Temperature setback thermostats have been known for several years and more recently, such setback thermostats with provision for two or more setback periods and separate cycles for, for example, weekend setting have appeared. These setback thermostats are typically a part of the thermostat unit rather than a part of the furnace control unit.

Integrated furnace control units, or units having at least some of the attributes of integrated control systems have also been known for some time. Illustrative of these known arrangements are the following U.S. Patents. U.S. Pat. No. 4,402,663 which provides for the detection of a flameout or low gas line pressure and suggests indicating the status of other possible malfunctions within the system. This patented arrangement provides a seven segment display for visual indication of a sensed problem. U.S. Pat. No. 3,781,161 which pretests a plurality of components by mimicing the start-up and shut-down processes. U.S. Pat. No. 4,444,551 which provides for a flame detector and light emitting diodes for visual indicators of a malfunction. This patented arrangement also allows three retrys or attempts at ignition and then shuts the system down. U.S. Pat. No. 4,295,129 which monitors main and pilot fuel flows and shuts down in response to an abnormal condition. U.S. Pat. No. 3,576,556 which discloses a flame detector circuit along with circuitry for pretesting the detector circuitry for component malfunctions. Finally, U.S. Pat. No. 4,243,372 teaches an arrangement for checking to see that an air flow sensor is operating properly as well as a purge cycle to clear the combustion chamber of accumulated gas prior to an ignition attempt.

These prior attempts to integrate furnace control typically fail to move the temperature setback feature to the integrated control, lack adequate fault displays for diagnostic purposes, lack a manually initiated test routing for diagnostic purposes, and are generally wanting in versatility.

Furnace controls typically respond to a call for heat from a thermostat when a thermostat switch closes completing a circuit to apply power, such as a 24 volt alternating current, to the control elements of the furnace. The present invention avoids a thermostat switch and, instead, transmits information indicating actual room temperature to the furnace control unit.

Furnace controls typically have all power removed and, except for the case of standing pilot lights, nothing happens when there is no demand for heat. The present invention continues to monitor several furnace parameters even when the temperature is within the desired limits.

In copending application Ser. No. 07/095,506 assigned to the assignee of the present application, entitled *INTEGRATED FURNACE CONTROL HAVING IGNITION AND PRESSURE SWITCH DIAGNOSTICS* and filed in the names of Grunden, Youtz and Mierzwinski on even date herewith and now allowed, there is disclosed a companion integrated furnace control system sharing some features with that disclosed herein and the entire disclosure thereof is specifically incorporated herein by reference.

Among the several objects of the present invention may be noted the provision of a versatile and economical integrated furnace control; the provision of a multifunction display device for use in a furnace control system; the provision of a furnace control test scheme operable before ignition is attempted, during furnace operation, and manually for diagnostic purposes; the provision of a furnace control which maintains a record of the time a selected component has been enabled, periodically compares this time with a preset time value, and provides an indication of the probable need for maintenance when the time of operation exceeds the preset time; the provision of a burner control which responds to an indication of actual temperature and, optionally, other parameters, and initiates the desired action; the provision of a furnace control system which continues to monitor temperature and other variables such as the status of a blower door and gas pressure even while no heat is being called for; and the provision of a furnace control test scheme which confirms proper operation of a wide variety of furnace functions and displays a diagnostic code indicative of any function fault detected. These as well as other objects and advantageous features of the present invention will be in part apparent and in part pointed out hereinafter.

Since the control uses one central microprocessor for all furnace functions, it can easily compare furnace sensor information and furnace operations, thus offering a wide variety in furnace control. Safety is enhanced since all sensor data can be evaluated and compared throughout the furnace operation. The control incorporates additional safety features such as a complete check of all sensors and gas valve relays prior to each ignition attempt; a check of the gas valve relay operation during the heating cycle; a check of the inlet gas pressure for a low pressure condition; and a backup for the conventional outlet air temperature limit switch. The control also offers furnace diagnostics which can alert the consumer to a furnace problem and give them an indication of the type problem. For example, the processor can record the accumulated time the blower fan or other furnace component has operated and when that time exceeds some prescribed value, a visual indication of the requirement for maintenance such as changing the air filter can be displayed.

The thermostat setback operation is unique in that the setback function is controlled from a panel on the furnace rather than on the wall thermostat. This permits a direct communication link to the main control board and allows for a much more simple wall thermostat. The setback functions differ from those normally encountered by providing selectable schedules and temperatures as options which are selected by changing switch positions rather than the typical complex programming method. For example, any one of several different weekday setback time schedules, and one of several different weekend setback time schedules, any one of several setback temperature increments may be selected.

In general, an integrated control for a burner is illustrated in the environment of a gas-fired furnace system of the type which may include a relay controlled pilot gas valve, a relay controlled main gas valve, an inlet gas pressure sensor, an inducer fan for forcing air through a combustion chamber in the furnace, means for sensing inducer fan forced air flow through the combustion chamber, a blower fan for circulating air through the furnace to be heated therein, a thermostat for providing a demand for heat signal to the control, a blower door switch, and a hot air temperature sensor for controlling the blower fan. The integrated control has circuitry for sequentially testing a plurality of the above recited furnace components prior to an attempt to ignite the furnace, as well as circuitry for sequentially testing said plurality of furnace components during furnace operation, and manually initiated circuitry for sequentially testing said plurality of furnace components at times other than prior to an attempt to ignite the furnace and during furnace operation.

Also in general, and in one form of the invention, an integrated burner control system is operate in each of three different modes to test a plurality of distinct burner components and selectively provide one visible indication if all tested components are operating in a satisfactory manner and any one of a plurality of other faulty component indicative indications in the event a tested component fails the test. A first mode is controlled to sequentially test a plurality of the furnace components prior to an attempt to ignite the furnace, a second mode is controlled to sequentially test said plurality of furnace components during furnace operation, and a third mode is controlled manually to sequentially test said plurality of furnace components at times other than prior to an attempt to ignite the furnace and during furnace operation.

Still further in general, and in one form of the invention, an integrated burner control system is operable to test a plurality of distinct burner components and selectively provide one visible indication if all tested components are operating in a satisfactory manner and any one of a plurality of other faulty component indicative visible indications in the even a tested component fails the test. A multifunction display panel is provided for selectively displaying selected ones of: the indication that tested components are operating in a satisfactory manner; a faulty component indicative indication; a day of the week; and the time of day.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1A:
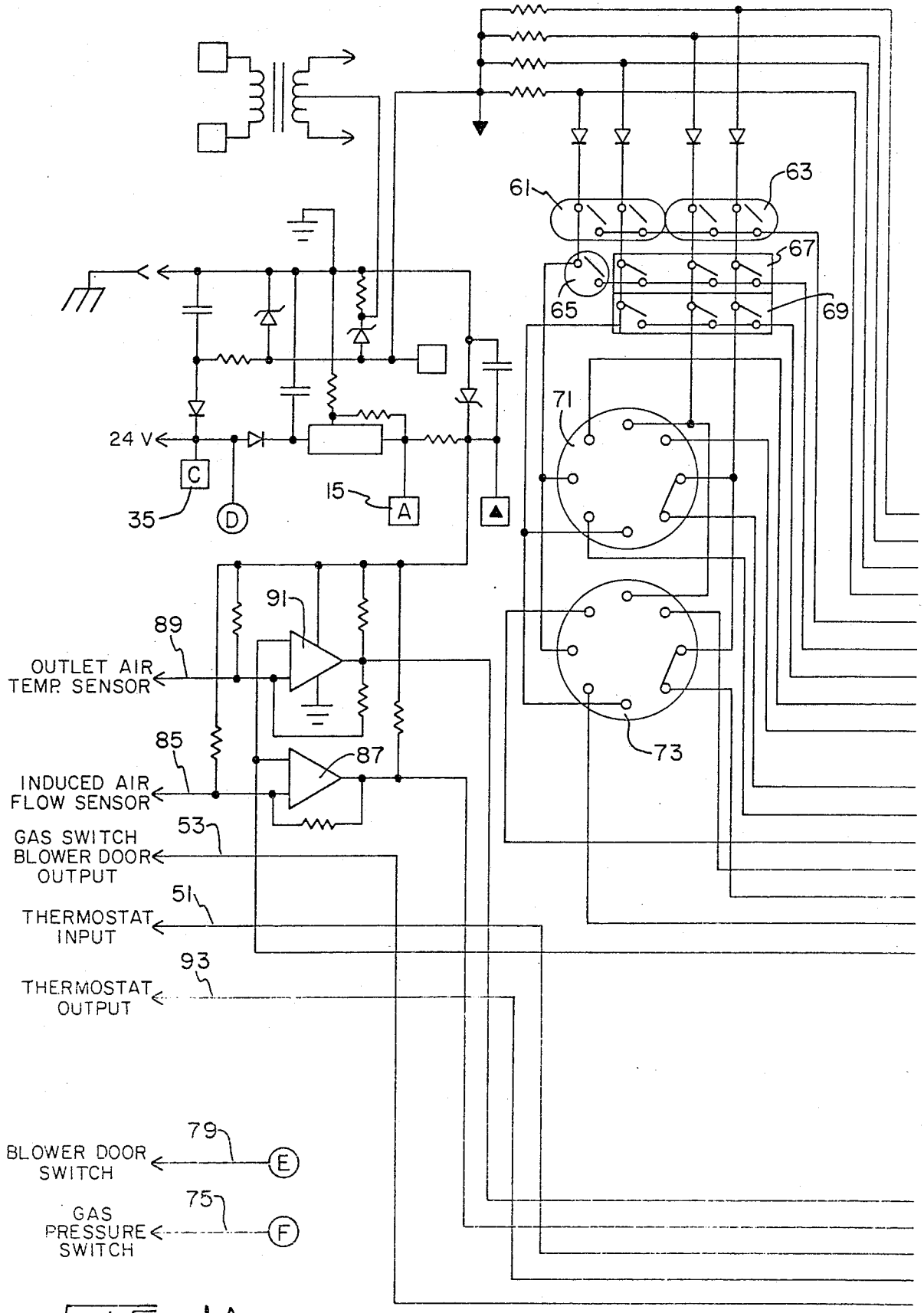
FIGS. 1A–1D, when joined, form a schematic diagram showing a furnace control according to one form of the invention.
Figure 1B:
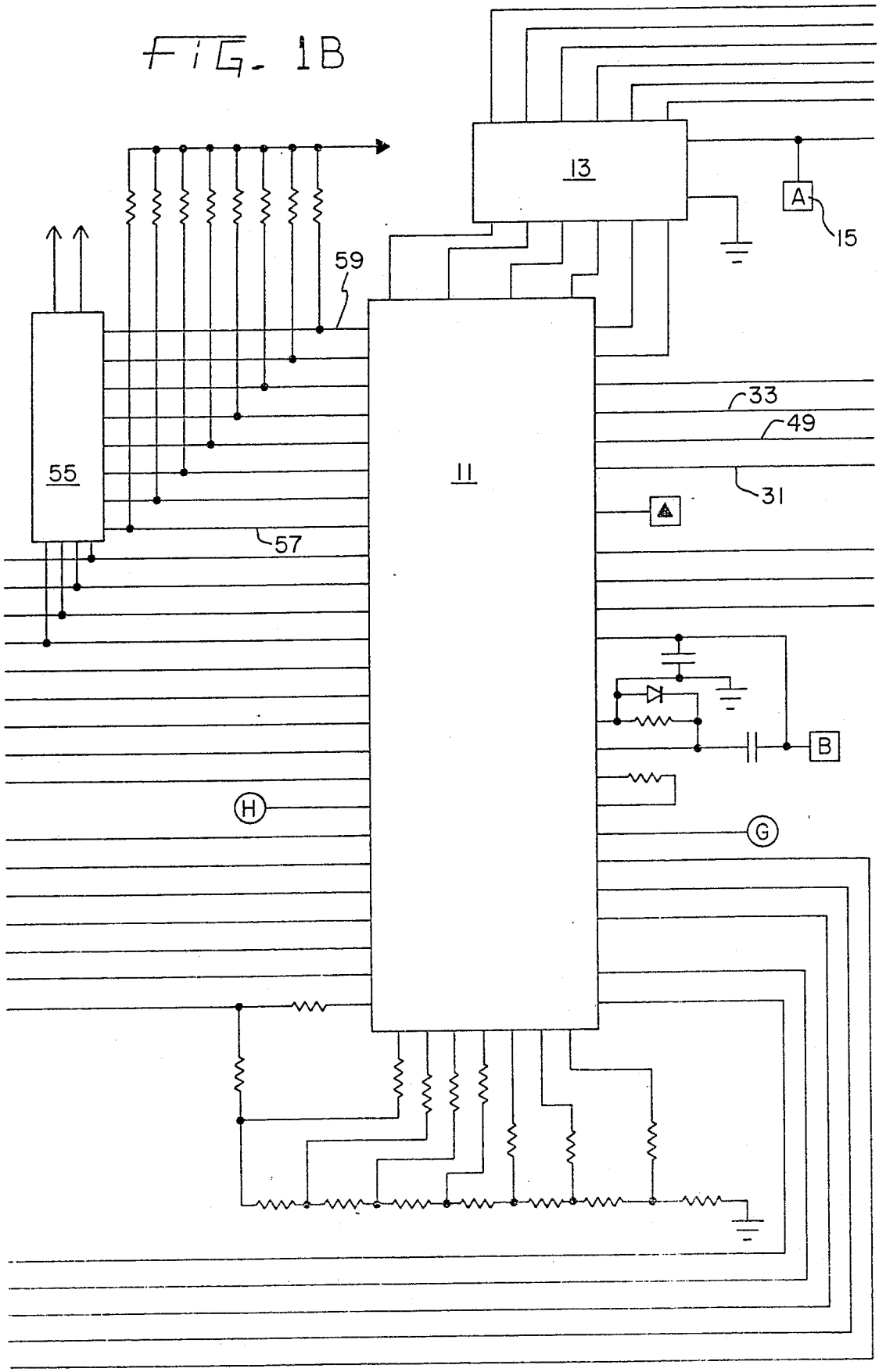
Figure 1C:
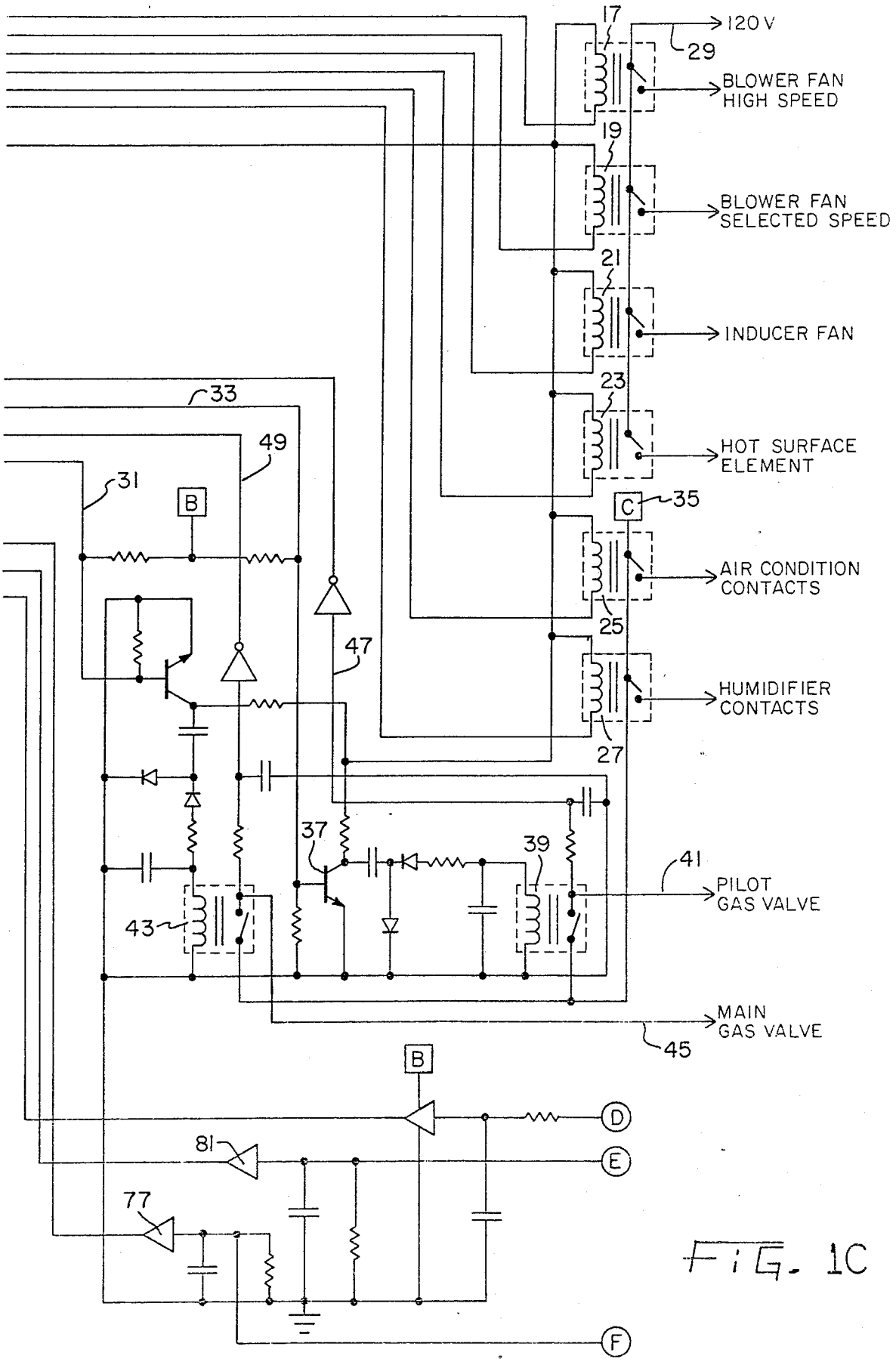
Figure 1D:
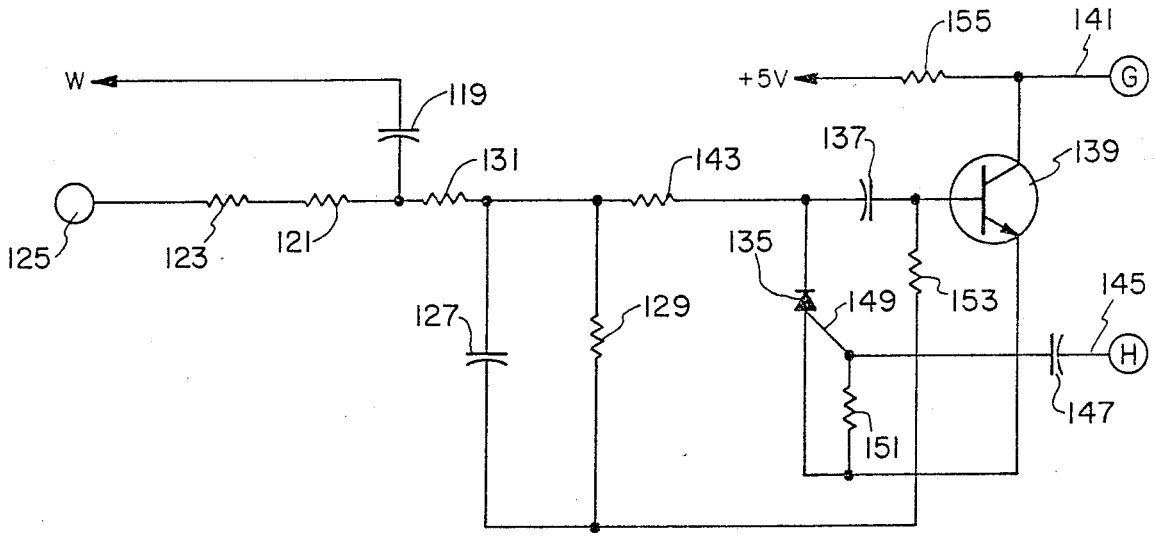
Figure 2A:
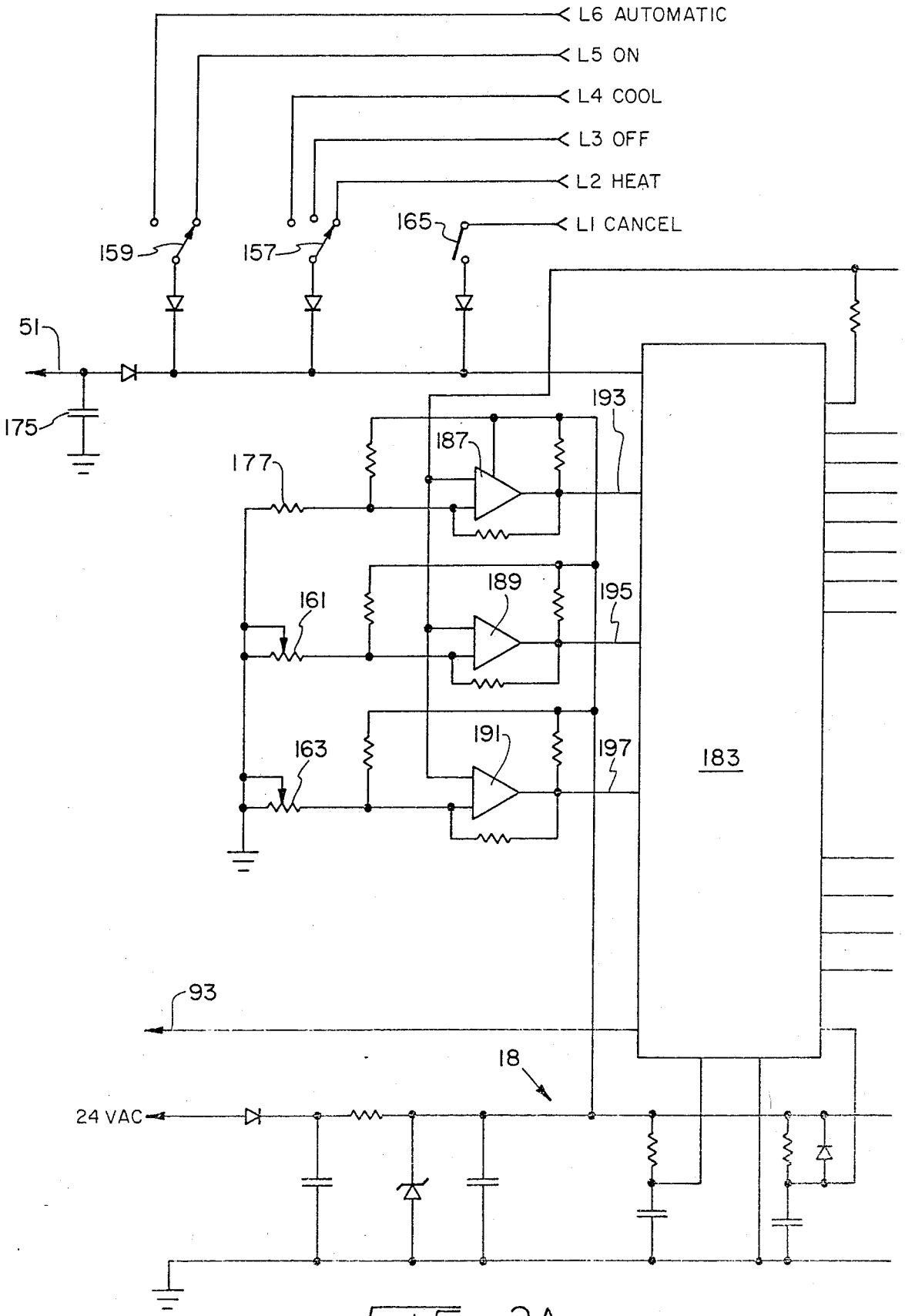
FIGS. 2A–2B, when joined, form a schematic diagram showing a remote thermostat module suitable for use in conjunction with the control of FIG. 1.
Figure 2B:
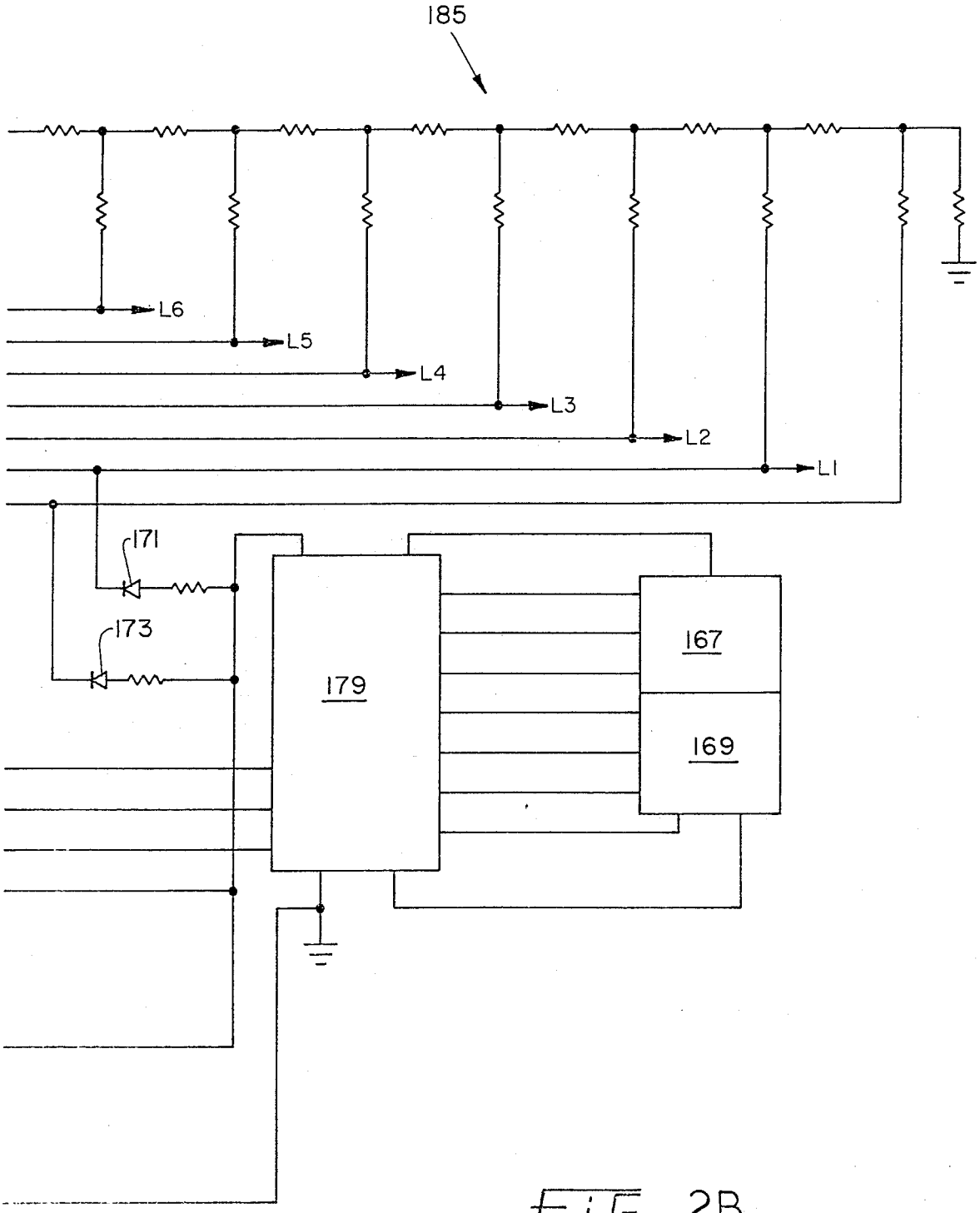

The integrated furnace control includes a main control module illustrated in FIG. 1 and a remote thermostat module illustrated in FIG. 2. The remote thermostat module provides the user interface by which the user communicates the desired temperature, humidity, and other operating parameters to the main control module. The main control module performs the various system tests, enables and disables the appropriate components at the appropriates times, and generally controls and monitors the system operation.

In FIG. 1, the nucleus of the integrated furnace control is the microcompressor 11 which has six outputs near the right side connected to a relay driver integrated circuit chip 13. The chip 13 functions as a power switch to supply power upon microprocessor command from source terminal 15 to the various control relays 17, 19, 21, 23, 25 and 27. These relays, when energized, supply a 120 volt enabling alternating current on line 29 to their respective components. Relay 17 controls a furnace blower fan in a high speed mode of operation. Relay 19 enables that same blower fan in a selected lower speed mode. Relay 21 enables the inducer fan which supplies combustion air to the furnace combustion chamber and, at certain times, performs a chamber purge to rid the chamber of gas prior to an ignition attempt. Relay 23 energizes a hot surface element for ignition a pilot flame during ignition. Relay 25 controls an air conditioner while relay 27 controls a humidifier with these last two relays supplying a 24 volt alternating current control voltage from source terminal 35 to the control relays of their respective units.

Microprocessor 11 provides two further control outputs on lines 31 and 33. An oscillating signal on line 33 is amplified by transistor 37 to energize the coil of relay 39. When the contacts of relay 39 close, power is supplied from terminal 35 to a pilot gas valve by way of line 41. At a later time, and if the prerequisite conditions are met, a signal on line 31 similarly enablers relay 43 to provide a main gas valve control voltage on line 45 to turn on the main gas flow. A confirmation signal indicating that the pilot gas valve has been actuated is returned via the closed relay contacts to the microprocessor on line 47 and, at a later time, a configuration that the main gas valve has been actuated is similarly returned on line 49. The techniques of the present invention may, of course, be embodied in a control of the type having but a single gas valve and another suitable gas valve relay enabling circuit is discussed in greater detail in copending application Ser. No. 07/095,507 assigned to the assignee of the present invention, entitled FAIL SAFE GAS VALVE DRIVE CIRCUIT and filed in the names of Victor F. Scheele and Stephen E. Youtz on even date herewith.

Information from the microprocessor which is to be displayed on a vacuum fluorescent display panel 55 is sent over lines such as 57 and 59. Display 55 has two rows of sixteen indicator segments each. The top row may be used to display hours of the day, an AM or PM indication and an indication of whether the system is set in a heating or a cooling mode. The lower row may display minutes in five ten minute increments, days of the week and four segments are reserved for fault indication codes. Finally, the microprocessor sends signals to the thermostat on line 51, and to a gas line pressure sensor and a switch which is closed only when the blower enclosure door is closed on line 53.

Data is entered into the microprocessor manually via the several switches located near the upper left hand corner of FIG. 1. The switches 61 and 63 are spring loaded tilt switches which may be depressed in either of two directions away from a neutral position to close either one of two sets of contacts. Switch 61 may be used to rapidly increment (either forward or reverse) the displayed hours on the upper row of display 55. Switch 53 is a toggle mechanism which, each time it is depressed, changes the function of switch between incrementing (again either forward or backward) the minutes portion of the lower row of display 55 and incrementing the days of the week portion. Switches 67 and 69 are three position slide switches for closing any selected one of the illustrated three sets of contacts in each. Switch 67 selects between the vacation setback mode, normal heating mode and manual test mode. Switch 69 selects between three different temperature setback increments, typically five, eight or ten degrees Fahrenheit. Rotary switch 71 is used to select any one of eight different preprogrammed weekday setback time schedules. Exemplary schedules could be 11 PM to 5 AM, or 11 PM to 6 AM and 8 AM to 3 PM. Rotary switch 73 is similarly used to select one of eight preset weekend setback time schedules. The setback control switches are scanned or checked periodically, every one to five seconds for example, and their current status stored in the microprocessor. If switch 67 is in the test position, the microprocessor immediately changes to the test mode. If switch 67 is in the vacation position, the microprocessor sets the furnace temperature to 55 degrees F. and the air conditioner temperature to 85 degrees F. regardless of the time of day and the other setback settings.

The microprocessor 11 receives information from several further sources. An indication of whether the gas line pressure is adequate or not is received on line 75 and passed on to the microprocessor by a buffer 77. A confirmation that the blower door is closed is received on line 79 and sent to the microprocessor via buffer 81. A flame sensor positioned within the combustion chamber supplies an indication that a pilot flame is present on line 141. An indication that the inducer fan is operating and an adequate flow of air is present is provided on line 85 and by way of operational amplifier 87 to the microprocessor. The outlet or plenum air temperature is sensed and when it reaches a certain temperature requiring blower fan operation, a signal on line 89 is passed by operational amplifier 91 to the microprocessor. The furnace control is in a standby mode until a signal on line 93 from the thermostat indicates a demand for heat.

The thermostat status on line 93 is read and stored sequentially every fifteen seconds by the microprocessor. If the thermostat mode switch 67 is in the cool mode position, the actual temperature is compared to the set point temperature and if it is higher than the set point temperature, the control will energize relay 25 and operate the air conditioner. The air conditioner will continue to run until the sensed room temperature is two degrees below the set point temperature and the blower fan is on high (relay 17 actuated) whenever the air conditioner is on.

If the mode switch 67 is in the heat mode position, the microprocessor 11 will first determine if it is in the setback mode by comparing the current time of day to the selected (switch 71 or 73) setback schedule. if the control determines that it is within the setback interval, the microprocessor will subtract the setback temperature (switch 69) from the set point temperature and compare the result to the actual room temperature. If the actual temperature is lower than the result or revised set point temperature, the microprocessor will initiate the ignition sequence; otherwise it will remain in the standby mode. If the system is not in the setback schedule, the step of subtracting the setback temperature is, of course, omitted and the operation is otherwise the same.

Still considering the system in the standby mode, if the thermostat information on line 51 indicates the fan switch on the thermostat is in the fan on position, the fan relay 17 will be energized and the fan will run at high speed until the switch is returned to the automatic position. The fan on position of this switch overrides all other fan controls except for the blower door switch. If the fan has been previously switched on during a heating cycle, the outlet air temperature indication on line 89 will continue to be monitored until that temperature is below 100 degrees F. after which the blower fan relay (17 or 19) is disabled. The microprocessor also sums operating time for the blower fan and when 400 hours have been accumulated, the code indicative of the need to change air filters is displayed.

When the thermostat issues a call for heat, the control enters the ignition mode which is designed to operate in a fail-safe manner. The flame sensing input on line 141 is first checked for a false indication that a flame is present. The flame sensor may be implemented in much the same manner as in the aforementioned copending application Ser. No. 07/095,506. In that copending application, the flame sensing method used is flame rectification. The microprocessor may receive flame sensing signals from a remote sensor or from the hot surface igniter element. A 24 volt alternating current signal is applied through capacitor 119, and resistors 121 and 123. The capacitor 119 acts as an isolator allowing a negative direct current voltage to appear across capacitor 127 and resistor 129 when a flame is present. The flame has the characteristics of a leaky diode thereby causing the rectification. Capacitor 127 reduces the ripple in the rectified direct current while resistor 131 matches the impedance of the flame to the rest of the circuit. Resistor 129 discharges capacitor 127 when the flame is removed. The presence of a flame is sensed by the microprocessor when gate 135 is enabled to discharge capacitor 137 through the base of transistor 139 thereby applying a pulse to line 141. The gate 135 may, for example, be a programmable unijunction transistor or PUT. Depletion of the charge on capacitor 137 is limited by resistor 143. The gate 135 is turned on by a 30 hertz square wave signal from the microprocessor 81 on line 145 which is passed through the capacitor 147 as a spike at the transitions in the square wave. Each negative spike turns on the gate 135 for about 40 microseconds. The gate terminal 149 of gate 135 is pulled to ground between pulses by resistor 151. When a flame is present, there is a negative two volts across gate 135. Resistor 153 functions to keep transistor 139 off between pulses while resistor 155 pulls up the input to the microprocessor on line 141 to the 5 volt level. The pulses to gate 135 turn on the transistor 139 for about 17 microseconds. The microprocessor samples the input on line 141 before and during the pulses to make sure that component failure is not falsely recognized as a flame present signal.

The integrity of the air flow sensor (line 85) is checked to determine if it is falsely indicating combustion air is flowing through the combustion chamber and the outlet air temperature indication on line 89 is checked to determine that it is within a proper range. The relays 39 and 43 are next checked to make sure neither is shorted. After passing these initial safety checks, power is applied to the inducer fan by closing relay 21 and the presence of air flow as indicated on line 85 is confirmed. Should any of these tests fail, the control will not attempt ignition, but rather will go to the test mode.

If air flow is proven, the control now energizes relay 23 to heat up the hot surface igniter, allows 45 seconds for the surface to reach a sufficiently high temperature and then energizes relay 39 to enable a flow of gas to the pilot burner. Closure of the contacts of the pilot gas valve relay 39 is confirmed by a signal on line 47. The relay 23 is deenergized 14 seconds after the pilot valve is turned on and, assuming confirmation of the presence of a pilot flame on line 141 has occurred, relay 43 is energized to supply gas to the main burner. If, for some reason, the prerequisite conditions for opening the main gas valve have not been met, the control shuts down the gas valves and returns to the ignition mode for at most two further attempts at ignition. A purge period of 30 seconds during which the inducer fan operates is provided between each attempt at ignition. Microprocessor 11 includes a counter for recording the number of ignition trials, which is reset to its initial valve upon successful ignition, and a purge timer to insure adequate ventilation of the combustion chamber between attempts at ignition both of which may be backed up and compared to provide added safety in the form of redundancy.

In the heating mode and with the thermostat requirement not yet satisfied, presence of the pilot flame is confirmed every line cycle. The closure of the main gas relay 43 and the outlet chamber temperature are confirmed every second. If the thermostat input information on line 51 indicates a need for humidifier operation, relay 27 is enabled only while relay 17 or 19 is closed and the blower fan is running and until the humidity request has been satisfied. The thermostat in put is updated every 15 seconds and when the indicated room temperature is two degrees above the set temperature, the control enters the shutdown mode.

When shutdown begins, the relays 37 and 39 are opened and the gas valves both close. Air outlet temperature continues to be monitored and when the sensor input on line 89 indicates the air temperature has dropped to 100 degrees F, the blower relay 17 or 19 is disabled as is the humidifier relay 27 should the humidifier still be operating. Furnace shutdown will also occur should a loss of flame indication appear on line 141, a loss of air flow signal appear on line 85, or a low gas pressure indication appear on line 75.

The test mode is entered either by a failure during furnace operation or manually by moving the switch 67 to the test mode position. In this mode each of the following functions are tested and the appropriate binary code displayed in the last four positions on the lower row of display 55:

| | |
|---|---|
| Pilot valve relay | 1000 |
| Main valve relay | 0100 |
| Flame sensor | 1100 |
| Outlet air temperature sensor | 0010 |
| Blower door | 1010 |
| Gas pressure | 0110 |
| Induced air flow | 1110 |
| No thermostat input | 0001 |
| Would not ignite | 1001 |
| Air filter | 0101 |
| Test complete-satisfactory | 1111 |

The no ignition code 1001 is displayed for failures outside the test mode, for example, after three unsuccessful attempts at ignition, and the test mode must be executed before the fault code can be cleared. If the accumulated blower time exceeds 400 hours, the 0101 code is displayed indicating the probable need for maintenance. The microprocessor counter or timer which maintains a record of this time is reset to zero by moving switch 67 to the test mode position.

Line 79 to the blower door switch continuously monitors the status of that door and when an interrupt signal, indicating that the door has been opened, is received all outputs except for display 55 will be shut off and the 1010 code will be displayed. The control will continue to update the display until the door has been reclosed at which time the control goes into the standby mode.

The gas pressure indication on line 75 is monitored during ignition, heating and test modes, and a switch closure indicative of low pressure must be recognized for a five second interval before the control will shut down because of a low pressure fault.

As noted earlier, any one of several predetermined setback time schedules may be selected by positioning the switch 71 while switch 73 allows selection of any of several weekend setback schedules. The eight positions of rotary switch 71 may, for example, correspond to the following weekday setback intervals.

11 PM–5 AM
11 PM–6 AM
11 PM–7 AM
10 PM–5 AM
10 PM–6 AM
12 AM–6 AM
12 AM–7 AM
11 PM–6 AM and 8 AM–3 PM.

Exemplary weekend setback intervals may be as follows.

1 AM–7 AM
1 AM–6 AM
12 AM–6 AM
12 AM–7 AM
12 AM–8 AM
11 PM–7 AM
11 PM–8 AM
11 PM–6 AM and 8 AM–3 PM In a typical installation, the control of FIG. 1 will be located near the furnace while the thermostat unit of FIG. 2 will be located in a living area to be heated by the furnace. The two units are interconnected by lines 51 and 93. The unit of FIG. 2 is referred to as a thermostat unit, but provides much more information than a conventional wall thermostat. Actual room temperature and other comfort setting information such as relative humidity are sent to the control and other information is exchanged between the two units on lines 51 and 93.

The more infrequently used user inputs such as setback schedule and setback temperature are controlled by switches on the control unit of FIG. 1, however, the more frequently used inputs such as the desired comfort settings of room temperature and relatively humidity are selected by switches and potentiometers located on the wall thermostat unit of FIG. 2. Referring now to FIG. 2, the heating, cooling or off modes are selected by the three position slide switch 157 which is illustrated in the heat position. The system is placed either in an automatic or a fan on mode by slide switch 159. This switch is illustrated in the fan on mode position. The desired room temperature is selected by properly positioning the slide potentiometer 161. The desired relative humidity is set by positioning the slide potentiometer 163. Push button switch 165 may be depressed to cancel temperature setback for one setback period.

Information on the room temperature and, optionally, the room relative humidity, is conveyed to the user by a pair of seven-segment liquid crystal display devices 167 and 169 driven by the driver circuit 179. The user is notified that the system is operating in a temperature setback mode by a green light emitting diode 171 and, when a furnace problem occurs, the red light emitting diode 173 is energized.

The actual relative humidity in the living space is sensed by a capacitor 175 the capacitance of which varies as a function of the relative humidity. Such capacitative sensors function over a range of 25% to 90% relative humidity. Room temperature is sensed by a thermistor 177 the resistance of which varies as a function of temperature.

A somewhat conventional power supply circuit 181 supplies power to the processor 183 and to the display drive circuit 179. A resistive ladder network 185 functions as a type of digital to analog converter to supply information, dependent in part on the positions of switches 157, 159 and 165, to the operational amplifiers 187, 189 and 191. These operational amplifiers return information on the sensed temperature, set temperature and set relative humidity back to the processor 183 on lines 193, 195 and 197 respectively.

In operation, the thermostat unit of FIG. 2 takes a reading of the actual room temperature and then scans the other switch positions, storing the information. The control then measures the room humidity and compares this reading to the humidity set point. This information along with the previously stored information is transmitted to the circuit of FIG. 1 for further processing. The thermostat module also receives information from the circuit of FIG. 1 to be used for the setback and alert indicators.

In summary, the conventional switch contacts of a thermostat have been eliminated in the present invention and instead the temperature of a living space is sensed, for example, by a thermistor, and a signal indicative of that actual temperature is transmitted to the control unit. The desired temperature set point is also transmitted to the control unit and the control compares those two temperatures. The control also checks for other things including temperature setback schedule, operating mode, day of the week and time of day, and then makes a decision taking the appropriate action. The control monitors furnace parameters even when the actual temperature is within the desired limits. This gives the control the capability to determine certain safety conditions. For example, if, after the temperature reaches the desired limits and the gas valve is turned off, the temperature in the furnace plenum has not dropped to an acceptable level, there has been a failure. The blower will continue to run, a warning light will alert the occupant, and the control will continue to attempt to shut down the system.

In one particular implementation of the present invention, the microprocessor 11 was a Texas Instruments TMS 7040, the driver chip 13 was a Sprague ULN 2003A and the display 55 was a Futaba BG181Z. An illustrative program listing for the microprocessor is shown in pages A-1 through A-25 as follows.

From the foregoing, it is now apparent that a novel integrated furnace control arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An integrated control for a gas-fired furnace system of the type having at least a relay controlled pilot gas valve, a relay controlled main gas valve, an inlet gas pressure sensor, an inducer fan for forcing air through a combustion chamber in the furnace, means for sensing inducer fan forced air flow through the combustion chamber, a blower fan for circulating air through the furnace, a thermostat for providing a comfort setting signal to the control, a hot air temperature sensor for controlling the blower fan, and means operable in response to inputs from said sensors and sensing means and said thermostat to control said valves so as to operate said furnace in a safe manner, the integrated control comprising: first means for sequentially testing a plurality of the above recited furnace components prior to an attempt to ignite the furnace, second means for sequentially testing said plurality of furnace components during furnace operation, and manually operable means for sequentially testing said plurality of furnace components at times other than prior to an attempt to ignite the furnace and during furnace operation.

2. The integrated control of claim 1 further comprising means for disabling the main gas valve relay and the pilot gas valve relay in the event of any indication from the second means of component failure during furnace operation.

3. The integrated control of claim 1 further comprising means for precluding any attempt to ignite the furnace in the event of any indication from the first means of component failure prior to an attempt to ignite the furnace.

4. The integrated control of claim 1 further comprising means responsive to any one of the first, second and manual means for providing a first visible indication indicative of all tested components operating properly and a component identifying one of several other visible indications indicative of a particular component not operating properly.

5. The integrated control of claim 1 further comprising ignition means operable upon an indication by said first means that all tested components are operating properly for enabling the pilot gas valve relay and for igniting a pilot flame, means for confirming the presence of a pilot flame, and means for enabling the main gas valve relay only upon confirmation of the presence of the pilot flame.

6. The integrated control of claim 5 further comprising means for attempting ignition a preset number of times after a first failure to confirm the presence of a pilot flame and to thereafter disable the ignition means.

7. The integrated control of claim 1 wherein each of the relay controlled pilot gas valve, relay controlled main gas valve, inlet gas pressure sensor, means for sensing inducer fan forced air flow through the combustion chamber, thermostat for providing a demand for heat signal to the control, and hot air temperature sensor for controlling the blower fan are tested by the first, second and manual means.

8. An integrated control for a gas-fired furnace system of the type having at least a relay controlled main gas valve, an inlet gas pressure sensor, an inducer fan for forcing air through a combustion chamber in the furnace, means for sensing inducer fan forced air flow through the combustion chamber, a blower fan for circulating air through the furnace, a thermostat for providing a comfort setting signal to the control, a hot air temperature sensor for controlling the blower fan, and means operable in response to inputs from said sensors and sensing means and said thermostat to control said valve so as to operate said furnace in a safe manner, the integrated control comprising: first means for sequentially testing a plurality of the above recited furnace components prior to an attempt to ignite the furnace, second means for sequentially testing said plurality of furnace components during furnace operation, and manually operable means for sequentially testing said plurality of furnace components at times other than prior to an attempt to ignite the furnace and during furnace operation.

9. The integrated control of claim 8 further comprising means for disabling the main gas valve relay and the pilot gas valve relay in the event of any indication from the second means of component failure during furnace operation.

10. The integrated control of claim 8 further comprising means for precluding any attempt to ignite the furnace in the even of any indication from the first means of component failure prior to an attempt to ignite the furnace.

11. An integrated burner control system for a furnace system of the type having at least a relay controlled main gas valve, an inducer fan for forming air through a combustion chamber in the furnace, means for sensing inducer fan forced air flow through the combustion chamber, a blower fan for circulating air through the furnace, a thermostat for providing a comfort setting signal to the control, means for controlling the blower fan, and means operable in response to inputs from said sensing means and said thermostat to control said valve so as to operate said furnace in a safe manner, the integrated control comprising:

first, second and third means, respectively operable in three different modes to test a plurality of the above recited furnace components, respectively, prior to an attempt to ignite the furnace, during furnace operation and at times other than prior to an attempt to ignite the furnace and other than during furnace operation, and means responsive to any one of the said first, second and third means for selectively providing a visible indication if all tested components are operating in a satisfactory manner and any one of a plurality of faulty component indicative indications in the event a tested component failed the test.

12. The integrated burner control system of claim 11 wherein said first means is operable in said first mode for sequentially testing a plurality of the furnace components prior to an attempt to ignite the furnace, said second means in operative in said second mode for sequentially testing said plurality of furnace components during furnace operation, and said third means is manually operable in said third mode for sequentially testing said plurality of furnace components at times other than prior to an attempt to ignite the furnace and other than during furnace operation.

13. The integrated burner control system of claim 12 further comprising means for disabling the main gas valve relay in the event of any indication from the second means of component failure during furnace operation and means for precluding any attempt to ignite the furnace in the event of any indication from the first means of component failure prior to an attempt to ignite the furnace.

* * * * *

UNITED STATES PATENT AND TRADEMARK OFFICE

CERTIFICATE OF CORRECTION

PATENT NO. : 4,872,828

DATED : October 10, 1989

INVENTOR(S) : Eugene P. Mierzwinski, Michael T. Grunden, Stephen E. Youtz

It is certified that error appears in the above-identified patent and that said Letters Patent is hereby corrected as shown below:

In the Abstract, line 3, "incororates" should be --incorporates--.

Col. 1, line 24, "setting" should be --settings--.

Col. 3, line 28, "operate" should be --operable--.

Col. 3, line 49, "even" should be --event--.

Col. 11, claim 10, line 3, "even" should be --event--.

Col. 12, claim 11, line 3, "forming" should be --forcing--.

Col. 12, claim 11, line 20, "the" should be deleted.

Col. 12, claim 12, line 5, the first instance of "in" should be --is--.

Signed and Sealed this

Ninth Day of February, 1993

*Attest:*

STEPHEN G. KUNIN

*Attesting Officer*

*Acting Commissioner of Patents and Trademarks*